US006739948B2

(12) United States Patent
Biskeborn

(10) Patent No.: US 6,739,948 B2
(45) Date of Patent: May 25, 2004

(54) SYNCHRONOUS TAPE HEAD POLISHING DEVICE AND METHOD

(75) Inventor: Robert Glenn Biskeborn, Holister, CA (US)

(73) Assignee: International Business Machines Corporation, Armonk, NY (US)

( * ) Notice: Subject to any disclaimer, the term of this patent is extended or adjusted under 35 U.S.C. 154(b) by 107 days.

(21) Appl. No.: 10/051,982

(22) Filed: Jan. 15, 2002

(65) Prior Publication Data

US 2003/0134572 A1 Jul. 17, 2003

(51) Int. Cl.[7] ..... B24B 1/00

(52) U.S. Cl. ..... 451/28; 451/5; 451/168; 451/170; 451/305

(58) Field of Search ..... 451/5, 168, 170, 451/9, 305, 28; 360/104, 107, 119, 121, 122, 126, 127

(56) References Cited

U.S. PATENT DOCUMENTS 5,475,553 A 12/1995 Saliba ..... 360/122
5,735,036 A 4/1998 Barr et al. ..... 29/603.12
5,885,131 A 3/1999 Azarian et al. ..... 451/5
5,913,716 A * 6/1999 Mucci et al. ..... 451/59
6,004,189 A * 12/1999 Phillips ..... 451/49
6,179,689 B1 * 1/2001 Ohno et al. ..... 451/41
6,447,374 B1 * 9/2002 Sommer et al. ..... 451/56
6,497,611 B2 * 12/2002 Sakurada et al. ..... 451/5

* cited by examiner

*Primary Examiner*—Lee D. Wilson
*Assistant Examiner*—Anthony Ojini
(74) *Attorney, Agent, or Firm*—Robert O. Guillot; IPLO Intellectual Property Law Office

(57) ABSTRACT

In the tape head polishing method of the present invention the tape head is moved orthogonally to the polishing medium (such as diamond polishing tape) direction of motion during polishing. The polishing medium motion is synchronized with the tape head motion, such that the polishing medium is held stationary when the tape head motion is stationary, and the polishing medium is moved when the tape head motion is approximately at a maximum velocity. The tape head velocity $V_H$ and the polishing medium velocity $V_T$ during the tape motion are generally related by the equation $V_T \leqq V_H$ Tan $\phi$, where Tan $\phi$=W/L, where W is the width of an insulation layer fabricated between a magnetic shield and a tape head read sensor element, and L is the length of a read sensor element.

8 Claims, 2 Drawing Sheets

SYNCHRONOUS TAPE HEAD POLISHING DEVICE AND METHOD

BACKGROUND OF THE INVENTION

1. Field of the Invention

The present invention relates generally to tape head polishing devices and methods, and more particularly to a tape head polishing device and method in which the motion of the polishing medium motion is synchronized with the tape head motion.

2. Description of the Prior Art

Recording heads for tape drives, hereinafter referred to as tape heads, are fabricated on wafer substrates utilizing photolithographic and thin film fabrication techniques, as are well known to those skilled in the art. Following the slicing of the wafers, the sensor head surface of the tape head is generally ground and lapped. A problem that often occurs during this lapping process is that the ductile metal of the magnetic shields of the tape head can be smeared across the insulation layers of the tape head to make contact with the sensor elements of the head, thus creating electrical shorts which will compromise the performance of the device. A tape head polishing step is generally next conducted, typically utilizing a diamond polishing tape or other polishing medium, in an attempt to remove the smears and to provide a final polished surface to the head. However, the prior art tape head polishing process has not been entirely successful in removing the smears, and tape heads are produced having smears that cause electrical shorts which degrade the performance of the tape heads. A need therefore exists for a tape head polishing device and method which will polish the tape head in a manner that substantially removes the smears, such that the problem of electrical shorts in the fabricated tape heads is diminished.

SUMMARY OF THE INVENTION

In the tape head polishing method of the present invention the tape head is moved orthogonally to the polishing medium direction of motion during polishing. While the typical polishing medium is a diamond polishing tape, the present invention is not to be so limited; however, for simplicity, the polishing medium shall be inclusively referred to herebelow as a polishing tape. The polishing tape motion is synchronized with the tape head motion, such that the polishing tape is held stationary when the tape head motion is stationary, and the polishing tape is moved when the tape head motion is approximately at a maximum velocity. The tape head velocity $V_H$ and the polishing tape velocity $V_T$ during the tape motion are generally related by the equation $V_T \leqq V_H \tan \phi$, where $\tan \phi = W/L$, where W is the width of an insulation layer fabricated between a magnetic shield and a tape head sensor element, and L is the length of a sensor element.

It is an advantage of the tape head polishing method of the present invention that magnetic shield metalization smears which cause electrical short circuits are substantially eliminated.

It is another advantage of the tape head polishing method of the present invention that tape heads are produced having a higher reliability and lower failure rate.

It is a further advantage of the tape head polishing method of the present invention that a higher throughput of properly functioning tape heads is achieved.

It is yet another advantage of the tape head polishing method of the present invention that the fabrication expense of tape heads is reduced due to the increased throughput of properly operating tape heads.

It is an advantage of the tape heads produced by the polishing method of the present invention that metalization smears are substantially eliminated, such that electrical shorts within such tape heads are reduced.

It is an advantage of the tape head polishing device of the present invention that metalization smears are substantially removed during the tape head polishing process.

These and other features and advantages of the present invention will no doubt become apparent to those skilled in the art upon reading the following detailed description which makes reference to the several figures of the drawings.

IN THE DRAWINGS

DETAILED DESCRIPTION OF THE PREFERRED EMBODIMENTS

Figure 1:
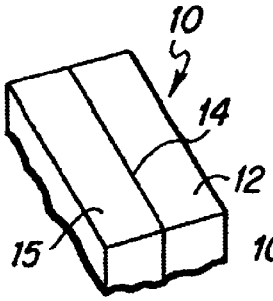
FIG. 1 is a perspective view of a top portion of a tape drive recording head.

Tape drive recording heads are fabricated in large quantities upon wafer substrates utilizing thin film deposition and photolithographic techniques as are well known in the art. FIG. 1 is a perspective view generally depicting a top portion of a tape head 10 which includes a substrate base 12, a linear sensor region 14 and a cover piece 15. Further details of the linear sensor region 14 are next described with the aid of FIG. 2 which is an enlarged top plan view of a central portion of the linear sensor region 14.

Figure 2:
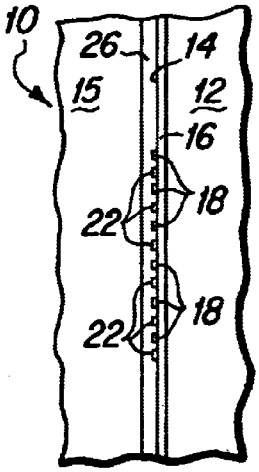
FIG. 2 is an enlarged top plan view of the tape drive recording head depicted in FIG. 1.

As depicted in FIG. 2, the sensor region 14 includes the substrate base 12 with an insulation layer 16, typically comprised of a material such as alumina, deposited thereon. A plurality of read head sensors 18 and write head sensors 22 are alternately fabricated upon the insulation layer 16, and a further insulation layer 26 is subsequently deposited upon the sensors 18 and 22. The cover piece 15 is then bonded to the insulation layer 26. The present invention relates to detailed features of the read head sensor elements 18, and an enlarged depiction of a single read head sensor is provided in FIG. 3 and next described.

Figure 3:
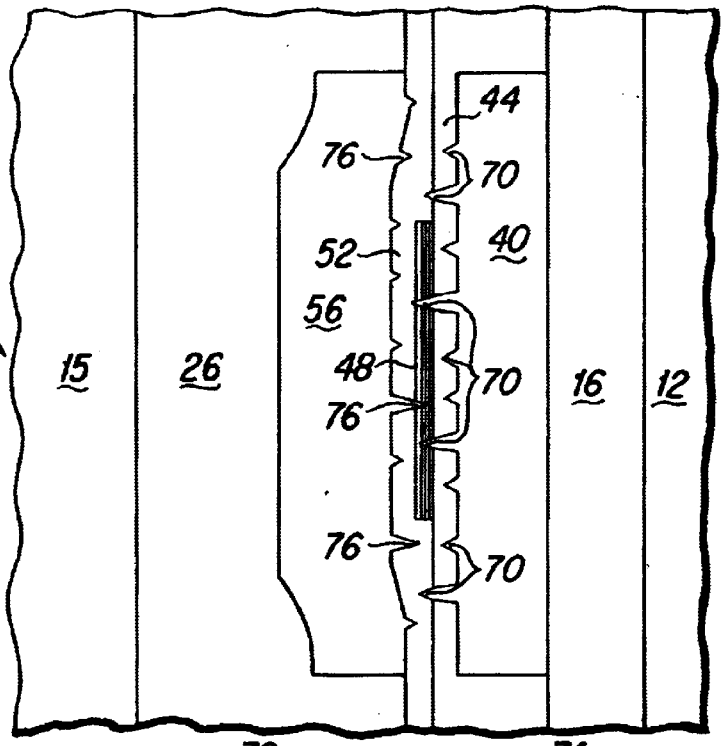
FIG. 3 is an enlarged view of a read head sensor portion of FIG. 2.

FIG. 3 is an enlarged top plan view of a read head sensor 18 of the head 10 depicted in FIGS. 1 and 2 following a head lapping process. As depicted therein, the read head sensor 18 includes a first magnetic shield (S1) 40 that is fabricated upon the insulation layer 16 at the location of the read head sensor 18. An insulation layer 44 is fabricated upon the S1 shield 40 and the read sensor element 48 (such as a magnetoresistive (MR) sensor that is composed of a plurality of thin film layers) is thereafter fabricated upon the insulation layer 44 above the S1 shield 40. Thereafter, a further insulation layer 52 is fabricated above the sensor element 48 and a second magnetic shield (S2) 56 is fabricated upon the insulation layer 52 to cover and shield the sensor element 48. The insulation layer 26 (mentioned above) is then deposited across the wafer surface and upon the S2 shield 56, and the cover piece 15 is bonded to the insulation layer 26. Following the wafer level fabrication steps, the heads 10 are sliced from the wafer and a tape head grinding and lapping process is undertaken to create a smooth upper surface upon the head. It is to be understood that the preceding generalized tape head fabrication description is sufficient for the purpose of providing a background understanding for the present invention that is described below, and that many more fabrication steps are undertaken to create a tape head 10, as are known to those skilled in the art.

Figure 4:
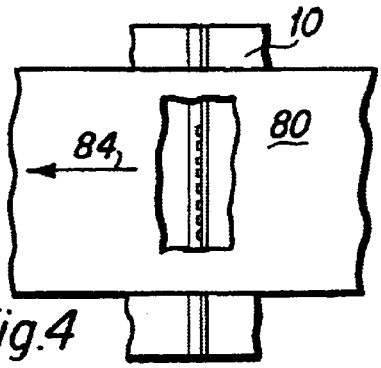
Fig.4 (PRIOR ART)
FIG. 4 is a top plan view of a prior art tape head polishing step.
Figure 5:
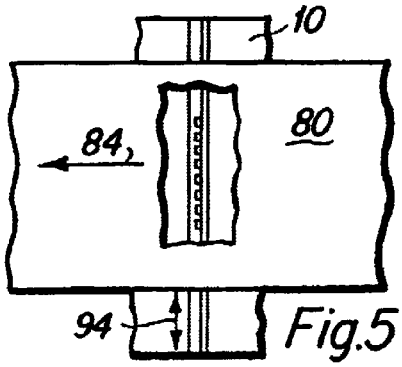
Fig.5 (PRIOR ART)
FIG. 5 is a top plan view of another prior art tape head polishing step.

A significant problem that exists in the tape heads following the head lapping process is that the directional nature of the lapping process can cause surface portions of the metal magnetic shield layers 40 and 56 to smear across the insulation layers 44 and/or 52 to create an electrical short between the magnetic shields 40 and/or 56 and the sensor element 48. Particularly, as is seen in FIG. 3, metalization smears 70 from the S1 shield 40 towards the sensor element 48 may be created where the relative motion of the head 10 to the lapping surface (not shown) is to the left (arrow 74), and metalization smears 76 may be created from the S2 shield 56 towards the read element 48 where the relative motion of the head 10 to the lapping surface (not shown) is to the right (arrow 78). The existence of the smears 70 and 76 created during the head lapping process is well known to those skilled in the art, and a polishing process using a polishing medium such as diamond tape is typically next undertaken following the lapping process to attempt to remove the smears, as well as to provide a final finished surface to the tape head. FIGS. 4 and 5 depict prior art tape lapping process steps, and FIGS. 6–9 depict the improved tape polishing method of the present invention, as are all next described.

FIG. 4 is a top plan view depicting a first prior art tape polishing step for the tape head 10 depicted in FIGS. 1–3. As depicted in FIG. 4, a portion of a diamond polishing tape 80 is disposed above the lapped head 10, such that the diamond polishing surface of the tape 80 makes contact with the surface of the head 10. In the prior art polishing method depicted in FIG. 4, the polishing tape 80 is moved laterally relative to the head 10; that is, the head is held stationary while the tape is moved laterally (arrow 84). While the prior art polishing method depicted in FIG. 4 is generally effective in polishing the surface of the head 10, the metal smears from the shields are not always effectively removed, and electrical shorts often still occur, such that a significant number of heads with electrical shorting problems exist. Furthermore, it is believed that smears may even be created or exacerbated in the FIG. 4 polishing method, as the polishing tape may cause further lateral movement of metal smear material.

FIG. 5 depicts an improved prior art tape polishing method in which the tape head 10 is moved orthogonally (see arrow 94) to a tape longitudinal axis centerline 96 which corresponds to the lateral polishing tape direction, see arrow 84. An improvement in the removal of the metal smears is achieved with this prior art tape polishing method depicted in FIG. 5, in that the vertical motion 94 of the tape head acts to remove the metal smears by a polishing action in the direction 94 that is orthogonal to the general lateral direction of the smears. Thus, the orthogonal polishing depicted in FIG. 5 tends to remove smeared metalization without tending to extend the smeared metalization across the insulation layers that separate the shields from the MR elements. However, it has been determined that the tape polishing method depicted in FIG. 5 is less than optimum, in that when the orthogonal motion 94 of the tape head is at the extreme upper or lower displacement, the orthogonal velocity of the head 10 is zero, while the polishing tape is simultaneously moving in a lateral direction 84, and at this point, the tape polishing method is similar to that depicted in FIG. 4. That is, the tape head is stationary and the polishing tape is moving laterally, which results in some smearing of the shield metal towards the read sensor element 48. As is next described with the aid of FIGS. 6–9, rather than having a prior art continuous tape motion, the tape polishing method of the present invention synchronizes the tape motion with the tape head motion, such that the polishing tape velocity is essentially zero at the point when the tape head orthogonal velocity is approximately zero (at its extreme displacement), whereby smearing during the tape polishing process is substantially eliminated, and the removal of smeared metalization from the lapping process is improved, such that an improved tape head is created.

Figure 6:
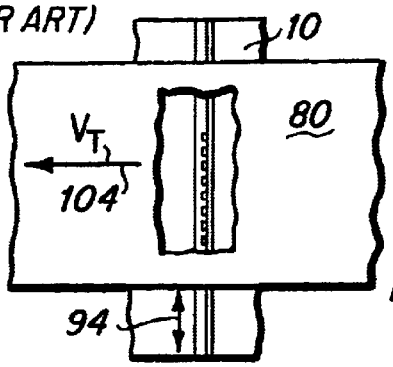
FIG. 6 is a top plan view depicting the tape head polishing process of the present invention.
Figure 7:
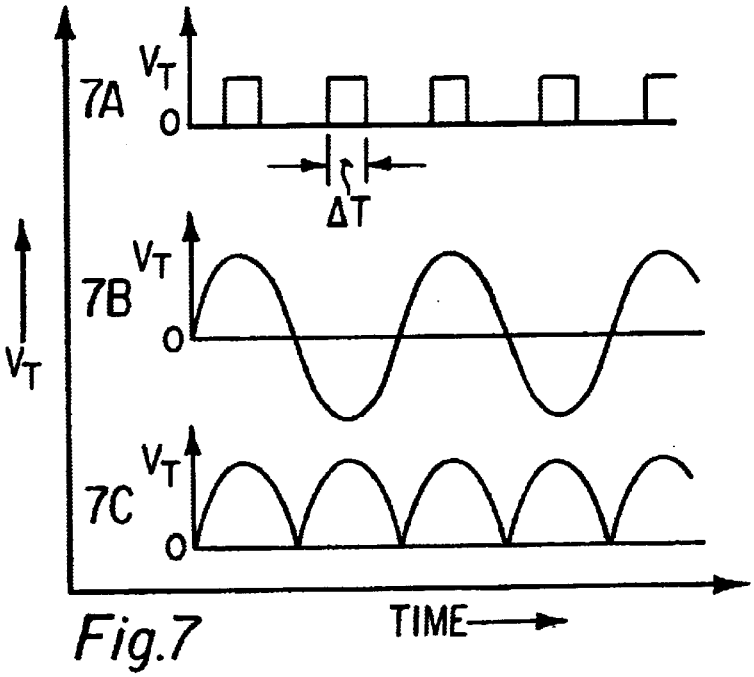
FIG. 7 is a graphical depiction of polishing tape velocity profiles.

FIG. 6 is a top plan view depicting the tape polishing method of the present invention, and FIG. 7 is a graphical depiction of exemplary tape motion profiles. As depicted in FIG. 6, the tape head 10 is moved in a reciprocating manner (see arrow 94) that is orthogonal to the direction of tape motion (see arrow 104). Significantly, the tape motion is not continuous, but rather it is varied to move with a velocity $V_T$ during a particular time period and zero during other time periods. FIG. 7 graphically depicts three polishing tape velocity profiles, it being understood that the present invention is not limited to such specific profiles. FIG. 7A is a step function, in which the tape velocity is a relatively constant $V_T$ during a time interval $\Delta T$ and zero at other time intervals. FIG. 7B is a sine wave velocity profile in which the polishing tape is moved forwards and backwards with a zero tape velocity during a portion of the tape motion, and FIG. 7C is similar to a rectified sine wave in which the tape velocity is unidirectional and varies, but is zero at particular points in time.

As indicated above, in the present invention the polishing tape motion is synchronized with the tape head motion. That is, the polishing tape motion is synchronized such that the lateral motion of the polishing tape occurs when the velocity $V_H$ of the tape head in its orthogonal motion is near its maximum. Assuming the tape head motion is approximately sinusoidal, the maximum velocity of the tape head will occur at the middle of its orthogonal motion, and the tape head will have zero velocity at the extremes of its motion. Thus, in the tape head polishing method of the present invention, the polishing tape is held nearly stationary during most of the orthogonal motion of the tape head, and the polishing tape is moved to an unused or different polishing tape portion by lateral motion of the polishing tape only when the lateral velocity of the polishing head is near a maximum value.

Figure 8:
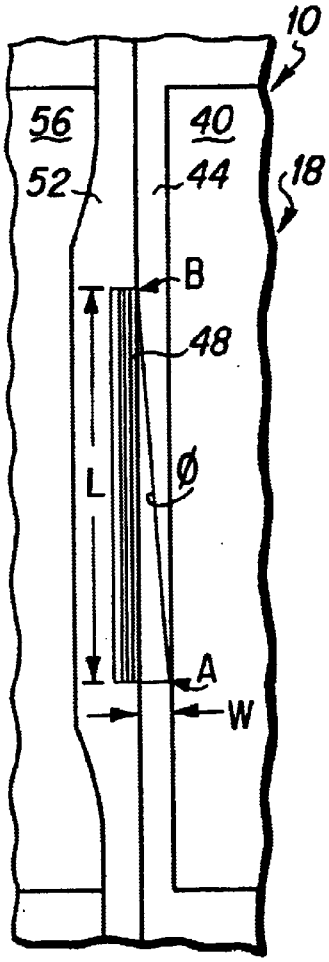
FIG. 8 is an enlarged view of a read head sensor depicted in FIG. 6.

The geometry of the tape head components creates certain relationships between the polishing tape velocity and the tape head velocity in order to be confident that the polishing tape lateral motion does not create smears that will extend across the insulation layers 44 and 52 from the magnetic shields 40 and 56 to the sensor element 48, and the enlarged view depicted in FIG. 8 will aid in the understanding of the relationships between the polishing tape motion and the tape head orthogonal motion.

As depicted in FIG. 8, an insulation layer 44 is deposited upon the S1 shield 40 with an insulation layer thickness W, and a read sensor element 48 having a length L is fabricated upon the insulation layer 44. Thus an angle $\phi$ having an opposite side W and an adjacent side L is created, whereby:

$$\text{Tan } \phi = W/L. \quad \text{EQ. 1}$$

A boundary smear condition during polishing tape and polishing head motion is that a metal smear originating at point A on the S1 shield 40 will not cross the insulation layer 44 to reach point B at the tip of the read sensor element 48. Returning to Eq. 1 it is seen that:

$$W = L \text{ Tan } \phi \quad \text{EQ. 2}$$

and the velocity relationship can be taken as the derivative with respect to time to yield:

$$dW/dt = dL/dt \text{ Tan } \phi \quad \text{EQ. 3}$$

where $dW/dt = V_T$ and $dL/dt = V_H$ such that:

$$V_T = V_H \text{ Tan } \phi \quad \text{EQ. 4}$$

In this relationship, $V_T$ is the velocity of the tape, and $V_H$ is the velocity of the head, where the tape motion is synchronized to be moving only during the time period when the tape head is moving at approximately its maximum velocity.

With regard to the various parameters identified above, W and T are fixed by the fabricated geometry of the head 10. The orthogonal motion and velocity of the head are selectable parameters as part of the tape head polishing method, and the polishing tape velocity, that is, movement distance in a selectable time period, are likewise selectable parameters as part of the tape head polishing method. Generally the desired relationship between $V_T$ and $V_H$ is that $$V_T \leqq V_H \text{ Tan } \phi \quad \text{EQ. 5}$$

to prevent smears from reaching across the insulation layer 44. A polishing device 120 of the present invention is next described with the aid if FIG. 9, which will provide a fuller understanding of the polishing method.

Figure 9:
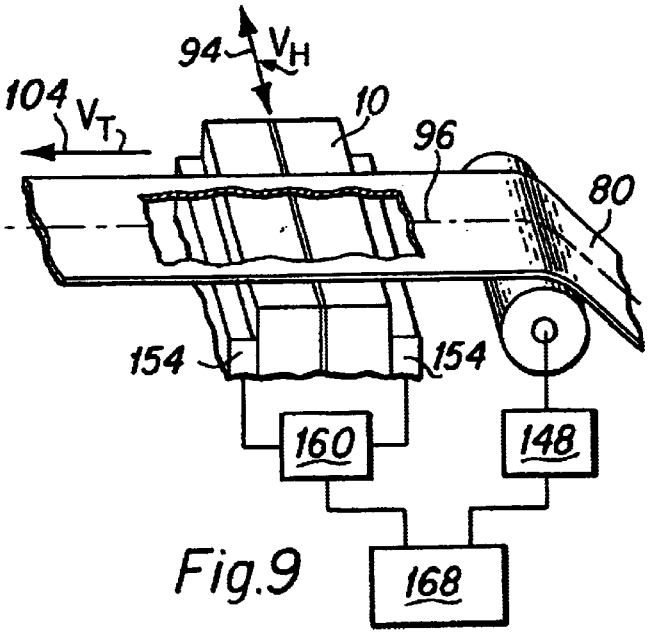
FIG. 9 is a generalized depiction of a tape head polishing device of the present invention.

As depicted in FIG. 9, a segment of polishing tape 80 having a longitudinal axis 96 thereof is mounted upon a tape movement control spool 128. A spool rotation control device 148 is engaged to the spool 128 to control the rotation of the spool, and thereby control the lateral motion of the tape. Many types of tape motion control systems are known to those skilled in the art, and they are generally utilizable with the present invention. A tape head 10 to be polished is mounted in a tape head holding fixture 154 that is disposed relative to the polishing tape such that the polishing surface (underside) of the polishing tape makes frictional, polishing contact with the tape head. The tape head holding fixture 154 is engaged with a tape head motion control device 160 that moves the tape head holding fixture, and thereby the tape head, in a periodic motion (see arrow 94) in a direction that is orthogonal to the longitudinal axis 96 of the tape. The tape head motion controller 160 and the polishing tape motion controller 148 are engaged with a motion synchronization device 168 that controls the motion of both the tape head motion controller 160 and the polishing tape motion controller 148. The motion synchronization device 168 acts to hold the polishing tape stationary during a portion of the periodic motion of the tape head, and to cause the polishing tape to move laterally during another portion of the periodic motion of the tape head, per arrow 104 of FIG. 6 and the tape motion profiles $V_T$ provided in FIG. 7. Generally, the polishing tape is held stationary when the tape head is disposed proximate the extremes of its motion; that is, when the tape head velocity is near zero. The synchronous motion controller allows the tape to move laterally to an unused portion of the tape when the velocity of the tape head is approximately at its maximum value (near the mid point of its motion). The orthogonal displacement motion of the tape head is preferably at least a distance L, where the lateral displacement of the polishing tape is approximately the distance W, such that the relationship between the velocity $V_H$ of the tape head and the velocity $V_T$ of the polishing tape is expressed in accordance with EQ. 5 hereabove. The tape polishing device 120 of the present invention has been implemented utilizing a Geneva gear device, which is known to those skilled in the art as a mechanical device for synchronizing the motion of two motion controlling devices. Of course, other types of motion synchronization controllers can be utilized to implement the present invention. An example of appropriate parameters is next provided for further understanding.

Regarding the orthogonal tape head motion, it is preferably though not necessarily selected that the tape head shall undergo a complete single cycle of motion (up and down) a total displacement of at least L while the polishing tape is nearly stationary. Regarding the polishing tape lateral movement, it is desired that the polishing tape shall move laterally a distance of no greater than W during a tape indexing motion. Now, if the tape head motion parameters, which define its maximum velocity, are next selected, the polishing tape velocity will be determined through the relationship set forth in EQ. 5. Conversely, if the polishing tape motion parameters that determine its velocity during its motion are first selected, the tape head motion parameters are determined by the relationship set forth in EQ. 5. In a preferred embodiment of the present invention, the following parameters have been determined to provide good results, in that metalization smears which traverse the insulation layer to cause an electrical short are not produced during the tape polishing process.

A tape head that was polished in accordance with the present invention includes a plurality of read sensor elements 48 having a length L of approximately 25 microns and an insulation layer having a thickness W of approximately 0.25 microns. The tape head was mounted in a fixture such that the periodic lateral motion of the tape head has a lateral displacement of approximately 1–2 millimeters and a maximum head velocity $V_H$ of 5 to 10 millimeters/sec. or higher. The polishing tape is mounted in a tape motion controller having the tape velocity profile of FIG. 7A, such that the lateral displacement of the tape during its motion is typically from a few microns/sec. to approximately 10 to 20 microns/sec., and the lateral tape velocity $V_T$ during its motion is typically 5 to 100 microns/sec. The polishing tape motion preferably occurs once during a tape head motion cycle when the tape head velocity $V_H$ is approximately at its maximum value.

It is therefore to be understood that a significant feature of the present invention is that the polishing tape is held generally stationary when the orthogonal velocity of the tape head is near zero, such that the polishing tape does not smear metalization from the magnetic shield across the insulation layer to the MR element. To move the polishing tape to an unused portion, the polishing tape motion is synchronized with the tape head motion, such that the polishing tape is moved only when the tape head velocity is near its maximum value. Any metalization smears that are caused by the polishing tape motion will thereby be directed primarily along the insulation layer, rather than across it, and the relationship that associates the tape movement with the head movement is expressed in EQ. 5 hereabove. The selection of the tape processing parameters is therefore within the ability of one of ordinary skill in the art upon reading the preceding disclosure.

While the invention has been shown and described with regard to certain preferred embodiments, it is to be understood that those skilled in the art will no doubt develop certain alterations and modifications therein as a result of reading this disclosure. It is therefore intended that the following claims cover all such alterations and modifications that nevertheless include the true spirit and scope of the invention.

What we claim is:

1. A method for polishing a tape head, comprising the steps of:

applying a polishing medium to the surface of a tape head for establishing a frictional contact of said polishing medium with said tape head, said polishing medium having a longitudinal axis direction thereof;

moving said tape head in a direction orthogonal to said longitudinal polishing medium axis, said motion of said tape head being periodic;

holding said polishing medium stationary during portions of said tape head movement when the velocity of said tape head is approximately zero;

moving said polishing medium in said longitudinal axis direction during other portions of said tape head movement when the velocity of said tape head is not approximately zero wherein said polishing medium is moved when said tape head is moving at approximately a maximum velocity, and said maximum velocity of said tape head occurs at approximately a midpoint in said periodic motion thereof.

2. The method for polishing a tape head as described in claim 1 wherein said tape head is formed with at least one magnetic shield and at least one read sensor element, and wherein an insulation layer is disposed between said magnetic shield and said read sensor element, and wherein said read sensor element is formed with a length L, and wherein said insulation layer is formed with thickness W; and wherein said maximum velocity of said tape head is $V_H$, and wherein the velocity of said polishing medium during said movement thereof is $V_T$, and wherein the relationship between $V_H$ and $V_T$ is described by the equation:

$$V_T \leqq V_H \mathrm{Tan}\phi$$

wherein Tan $\phi$ equals W/L.

3. The method for polishing a tape head as described in claim 2 wherein said tape head orthogonal motion has a displacement of at least approximately L, and said polishing medium lateral motion has a displacement of approximately W.

4. The method for polishing a tape head as described in claim 1 wherein said polishing medium motion occurs once during each period of said tape head motion.

5. A tape head that is polished in a tape polishing process comprising the steps of:

applying a polishing medium to the surface of a tape head for establishing a frictional contact of said polishing medium with said tape head, said polishing medium having a longitudinal axis direction thereof;

moving said tape head in a direction orthogonal to said longitudinal polishing medium axis, said motion of said tape head being periodic;

holding said polishing medium stationary during portions of said tape head movement when the velocity of said tape head is approximately zero;

moving said polishing medium in said longitudinal axis direction during other portions of said tape head movement when the velocity of said tape head is not approximately zero wherein said polishing medium is moved when said tape head is moving at approximately a maximum velocity, and said maximum velocity of said tape head occurs at a approximately a midpoint in said periodic motion thereof.

6. The tape head as described in claim 5 wherein said tape head is formed with at least one magnetic shield and at least one read sensor element, and wherein an insulation layer is disposed between said magnetic shield and said read sensor element, and wherein said read sensor element is formed with a length L, and wherein said insulation layer is formed with a thickness W; and wherein said maximum velocity of said tape head is $V_H$, and wherein the velocity of said polishing medium during said movement thereof is VT, and wherein the relationship between $V_H$ and $V_T$ is described by the equation:

$$V_T \leqq V_H \mathrm{Tan}\phi$$

wherein Tan $\phi$ equals W/L.

7. The tape head as described in claim 6 wherein said tape head orthogonal motion has a displacement of at least approximately L, and said polishing medium lateral motion has a displacement of approximately W.

8. The tape head as described in claim 5, wherein said polishing medium motion occurs once during each period of said tape head motion.

* * * * *